United States Patent [19]

Edwards et al.

[11] 4,174,051

[45] Nov. 13, 1979

[54] PROTECTIVE LOCKING FLAPS FOR OPENING IN SEALED CORRUGATED CONTAINERS

[75] Inventors: Edgar B. Edwards, Warren, Pa.; Richard G. Wachter, Middletown, Conn.

[73] Assignee: The Continental Group, Inc., New York, N.Y.

[21] Appl. No.: 928,324

[22] Filed: Jul. 26, 1978

[51] Int. Cl.[2] ..... B65D 5/60; B65D 5/46

[52] U.S. Cl. ..... 222/105; 220/288; 220/462; 220/465; 222/183; 229/37 R; 229/52 A

[58] Field of Search ..... 220/462, 463, 465; 229/52 A, 37 R; 222/105, 183; 220/256, 288

[56] References Cited

U.S. PATENT DOCUMENTS

| | | | |
|---|---|---|---|
| 2,942,771 | 6/1960 | Spigelman | 229/52 A |
| 2,981,455 | 4/1961 | Cope | 220/462 X |
| 3,087,655 | 4/1963 | Scholle | 222/183 |
| 3,138,293 | 6/1964 | Roak et al. | 222/105 |
| 3,157,342 | 11/1964 | Grady | 220/463 |
| 3,179,323 | 4/1965 | Miller | 220/462 |
| 3,226,002 | 12/1965 | Walker | 222/183 X |
| 3,370,774 | 2/1968 | Hopf | 222/183 X |
| 3,499,582 | 3/1970 | Berney | 222/183 |

FOREIGN PATENT DOCUMENTS

| | | | |
|---|---|---|---|
| 1098401 | 1/1968 | United Kingdom | 220/462 |

*Primary Examiner*—Allan N. Shoap
*Attorney, Agent, or Firm*—Charles E. Brown

[57] ABSTRACT

A carton particularly constructed for receiving a container having a spout wherein the top closure flaps of the carton have openings means for permitting the projection of the spout for the purpose of filling the container or dispensing the contents thereof. The opening means includes deflectable flaps in inner flaps aligned with a through opening in the outer flaps with the deflectable flaps serving to protect a dust cover carried by the closure against direct engagement by the container spout. The deflectable flaps are bendable through the through opening in the outer flaps and serve to define a lock to hold the spout in its extended or projected position. The deflectable flaps have intermediate fold lines facilitating the folding thereof to release the spout.

11 Claims, 6 Drawing Figures

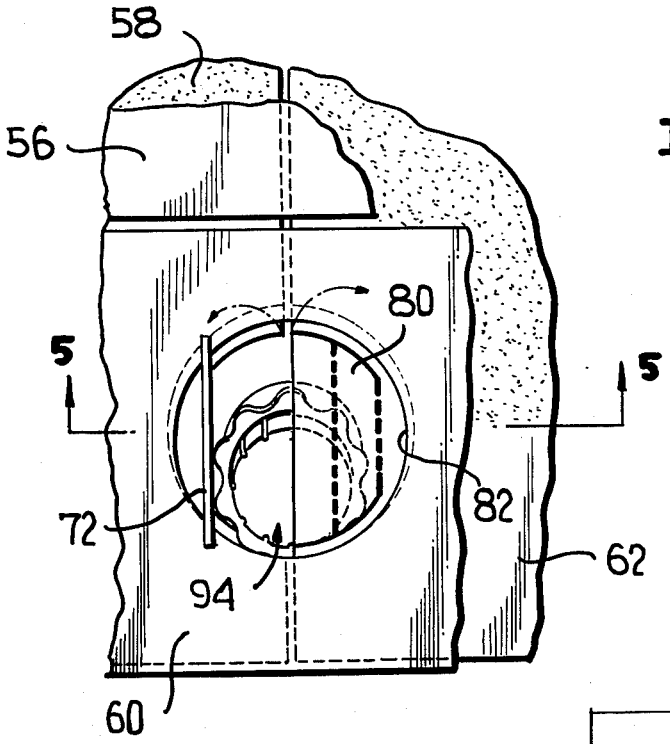
FIG.4
FIG.6
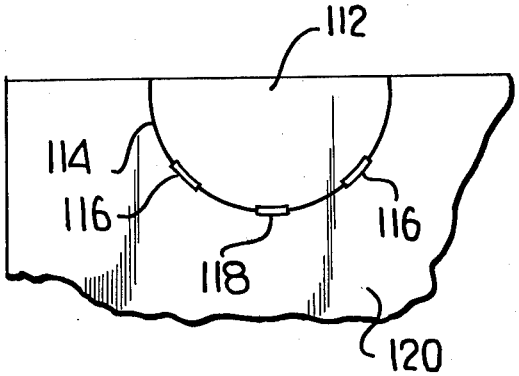
FIG.5
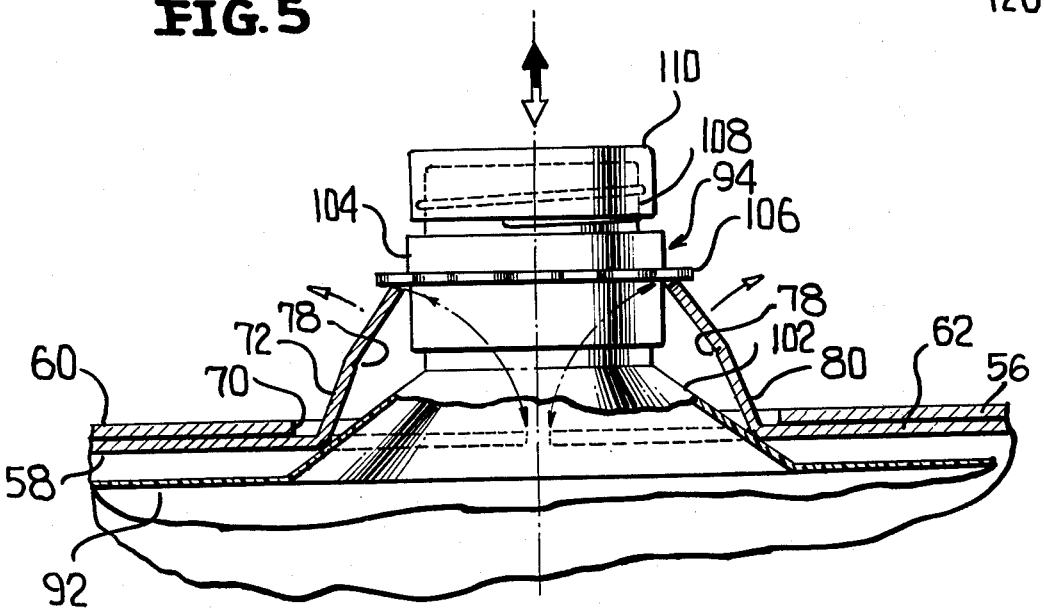

PROTECTIVE LOCKING FLAPS FOR OPENING IN SEALED CORRUGATED CONTAINERS

This invention relates in general to new and useful improvements in containers, and more specifically to a carton which has positioned therein a flexible plastic container including a flexible pull-up spout for filling and dispensing from the plastic container.

It is well known to provide composite containers which include a corrugated carton outer pack having therein a flexible plastic inner pack or container, which plastic container has a flexible pull-up pour spout. The corrugated carton has a top closure with an opening therethrough through which the spout may be projected for facilitating filling of the container and dispensing a product therefrom.

In order to prevent entry of dust and other foreign matter, the opening in the carton through which the spout may be projected is closed with a dust cap. The dust cap would normally entirely overlie the spout and nothing would prevent the spout from engaging the dust cap and rupturing the dust cap during shipment.

In accordance with this invention, it is proposed that the opening in the carton top closure include inner deflectable flaps which are normally positioned between the spout and the dust cap, and thus serve to provide a buffer between the spout and the dust cap or cover.

Another feature of the invention is to so form the deflectable flaps whereby they are bendable relative to the closure flaps from which they are formed for passage through outermost closure flaps to serve as locking means for retaining the spout in a projected position.

Another feature of the invention is the formation of the deflectable flaps with intermediate fold or score lines wherein the deflectable flaps may be bent so as to effect the releasing thereof from a projected spout.

In accordance with this invention, a carton will be provided with inner flaps and outer flaps, the outer flaps extending across both inner flaps and being suitably secured thereto. The inner flaps have opposed free edges and the deflectable flaps are formed from the material of the inner flaps adjacent the free edges with the deflectable flaps being aligned with each other and in combination with each other being deflectable to form a single opening through which the spout may pass.

Preferably, the deflectable flaps are offset from the centers of the respective free edges so that the single opening formed thereby is completely underlying one of the outer flaps and the outer flap has a through opening through which the deflectable flaps may project.

The carton is also provided with a carrying strap with end portions anchored relative to the inner flaps. Preferably, the outer flaps have free edges in opposed adjacent relation, and these free edges are notched to facilitate the passage of the carrying strap.

With the above and other objects in view that will hereinafter appear, the nature of the invention will be more clearly understood by reference to the following detailed description, the appended claims, and the several views illustrated in the accompanying drawings.

In the drawings:

FIG. 4 is a fragmentary plan view of the carton of FIG. 3 with portions of the closure flaps broken away, the dust cover removed and one of the deflectable flaps lifted through the outer closure flap.

FIG. 5 is an enlarged fragmentary vertical sectional view taken generally along the line 5—5 of FIG. 4, and shows the container spout in its projected position locked in place by the deflectable flaps.

FIG. 6 is a fragmentary plan view of an inner closure flap having a modified form of deflectable flap.

Figure 1:
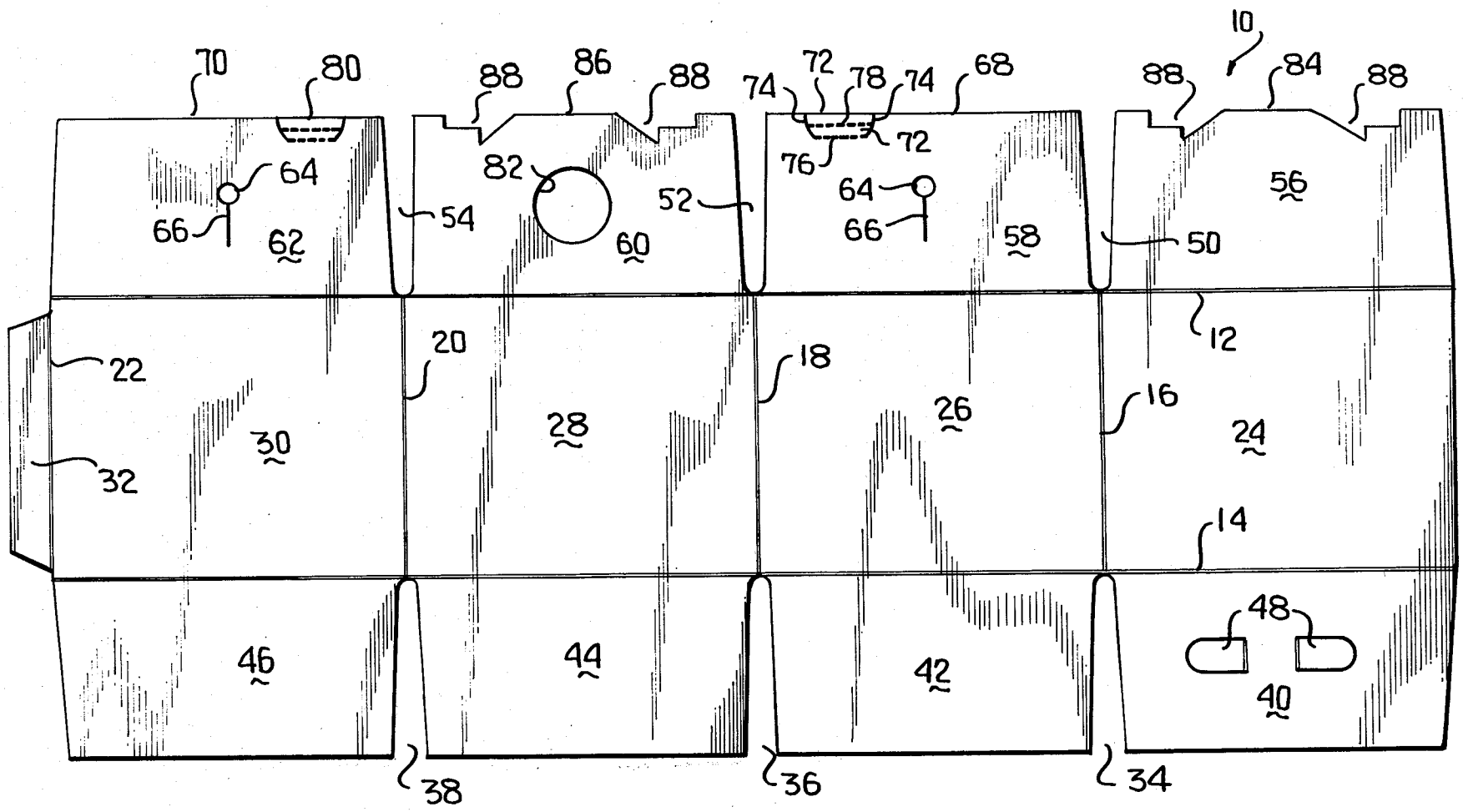
FIG. 1 is a plan view of a blank for the carton.

Referring now to the drawings in detail, reference is made first to FIG. 1 wherein the carton blank from which the carton is formed is illustrated. The carton blank is generally identified by the numeral 10 and is normally formed of corrugated board, although other paperboard products could feasibly be utilized. The blank 10 is generally rectangular in outline and has formed therein two longitudinally extending score or fold lines 12, 14. Extending between the fold lines 12, 14 are score or fold lines 16, 18 and 20. Also generally at one end of the blank 10 is a score or fold line 22 which extends transversely to the fold lines 12, 14. The fold line 16 defines at one end of the blank between fold lines 12, 14 a body panel 24. Adjacent the body panel 24 and between the fold lines 16, 18 is a body panel 26. Next, adjacent the body panel 26 and defined by the fold lines 18, 20 is a body panel 28. A body panel 30 is generally defined at the opposite end of the blank by the fold line 20. A securing flap 32 is set off from the panel 30 by the fold line 22.

The blank 10 outwardly of the central portion thereof and adjacent the fold line 14 is provided with transversely extending cutouts 34, 36 and 38 which are aligned with the fold lines 16, 18 and 20. The cutout 34 defines an outer bottom closure flap 40 which is aligned with and hingedly connected to the body panel 24. A similar, but inner, closure flap 42 is defined by the cutouts 34, 36 and is hingedly connected to the body panel 26. A second outer bottom closure flap 44 is defined by the cutouts 36, 38 and is hingedly carried by the body panel 28. Finally, the cutout 38 defines a second inner bottom closure flap 46 which is hingedly carried by the body panel 30.

When desired, the closure flap 40 may be provided with cutouts 48, which define finger receiving openings to facilitate the supporting of the bottom of the resultant container construction during the pouring of a product.

The blank 10 is provided with further cutouts in the portion thereof disposed outwardly of the fold line 12. These cutouts are cutouts 50, 52 and 54 which are aligned with the fold lines 16, 18 and 20, respectively. The cutouts 50, 52 and 54 together with the fold line 12 define upper closure flaps which include closure flaps 56, 58, 60 and 62 which are hingedly connected to the panels 24, 26, 29 and 30, respectively. The flaps 58 and 62 are inner flaps and the flaps 56 and 60 are outer flaps.

The inner flaps 58, 62 are provided with small diameter cutouts 64, each having extending therefrom toward the fold line 12 a slit 66. The cutout 64 and the slit 66 are used in a manner to be described hereinafter for anchoring a carrying strap. The closure flap 58 has a free edge 68 remote from the fold line 12 and the closure flap 62 has a similar free edge 70. Formed in the closure flap 58 immediately adjacent the free edge 68 and offset from the center of the free edge 68 is a deflectable flap 72. The deflectable flap 72 is generally semicircular in outline and is in part defined by a pair of arcuate cuts 74 which extend to the free edge 68. Inner ends of the cuts 74 are joined by a fold or score line 76 which extends substantially parallel to the free edge 68. The deflectable flap 72 has further formed therein an intermediate score or fold line 78 which is also generally parallel to the free edge 68 and serves to permit the deflectable flap 72 to be folded out of the general plane thereof for a purpose to be described hereinafter.

The closure flap 62 is also provided with a deflectable flap 80 along its free edge 70. The construction of the flap 80 is identical to that of the flap 74 and will not be described in detail here. It is to be noted, however, that the flap 80 is offset from the center of the free edge 70 in a direction opposite from that of the flap 72 so that when the flaps 58, 62 are folded to their carton closing positions and the free edges 68, 70 thereof are in opposed adjacent relation, the flaps 72 and 80 will be aligned with each other.

The closure flap 60 is provided with a central through opening 82 which is illustrated as being of a circular outline. It is to be noted that the position of the through opening 82 is such that in the closed condition of the carton the deflectable flaps 72, 80 will be aligned with the opening 82. It is also to be noted that the relative sizes of the flaps 72, 80 and the opening 82 are such that the flaps 72, 80 may be bent or folded out through the opening 82.

Finally, it is to be noted that the flaps 56, 60 have free edges 84, 86, respectively, and along those free edges the flaps 56, 60 are provided with pairs of cutouts or recesses 88 which in the closed condition of the carton are aligned with the openings 64 and the slit 66. The cutouts 88 combine to define an arrow-shaped notch having a head aligned with the opening 64 and a stem aligned with the slit 66.

Figure 2:
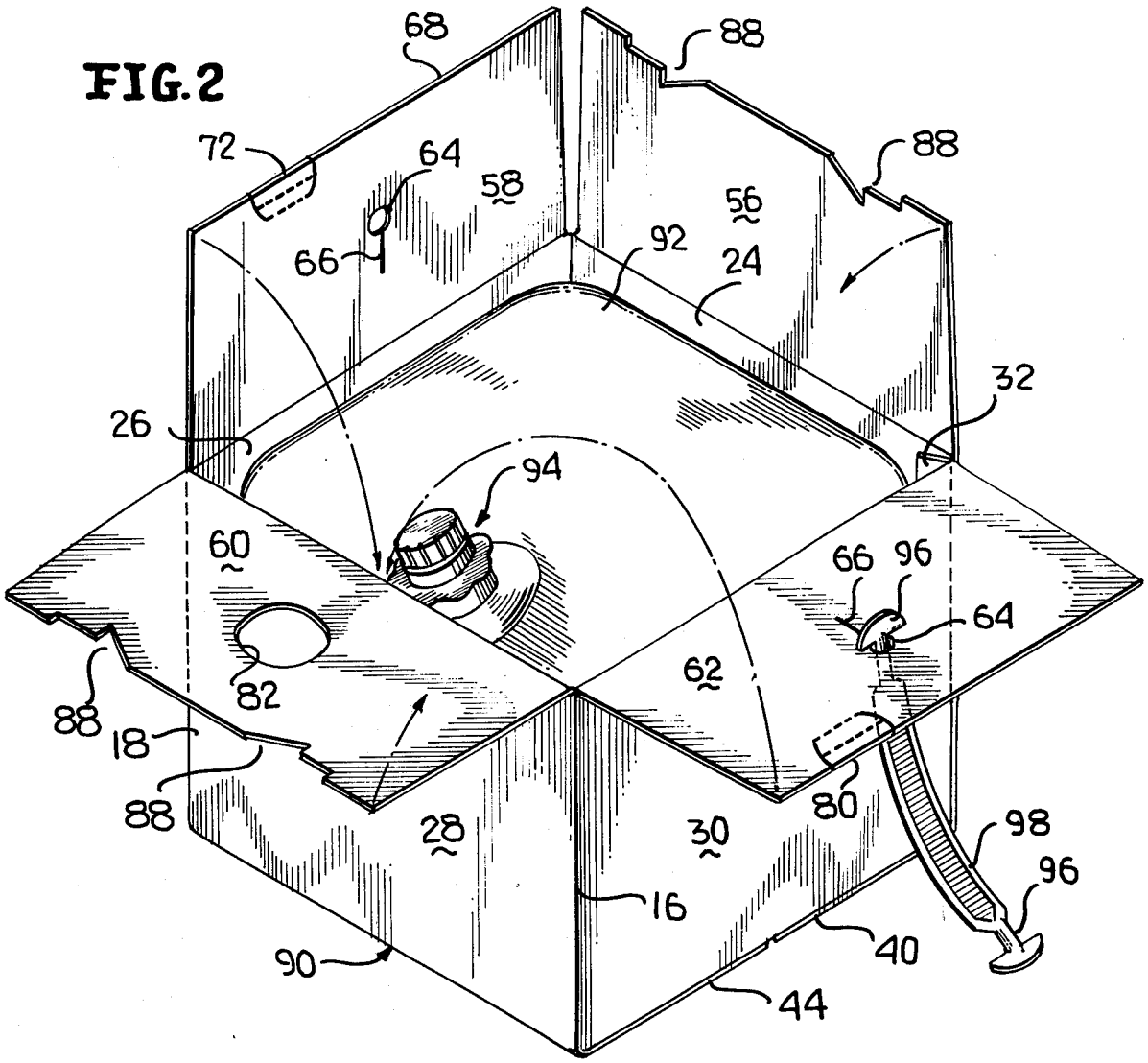
FIG. 2 is a top perspective view of the erected carton with the plastic container disposed therein and the top closure flaps in their open positions.
Figure 3:
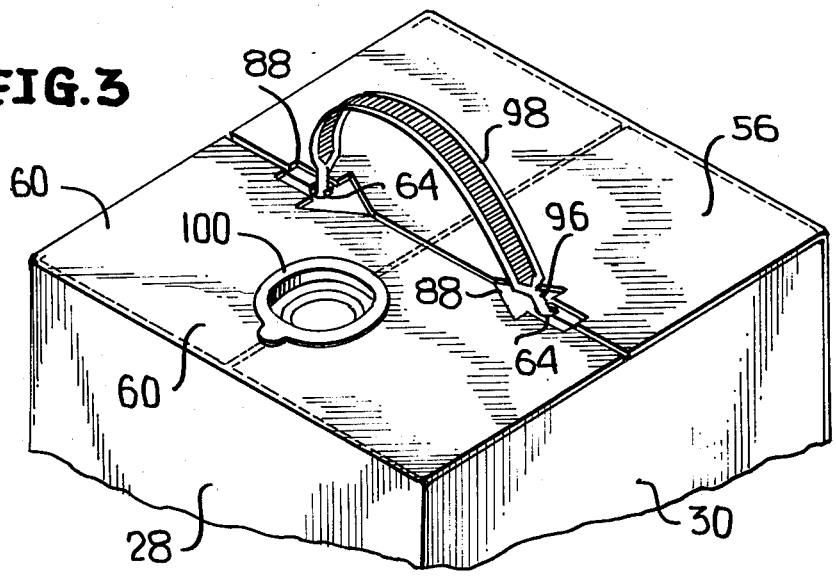
FIG. 3 is a fragmentary top perspective view similar to FIG. 2, but showing the carton in its closed position with the carrying strap in its carrying position and the carton sealed by a dust cap.

Referring now to FIG. 2, it will be seen that there is illustrated a carton 90 formed from the blank 10. The body of the carton is formed by folding the body panels along their respective fold lines and then securing the securing flaps 32 against the inner surface of the body panel 24. Thereafter, the bottom of the carton 90 is formed by inwardly folding the bottom closure flaps and securing them together in a conventional manner. The carton 90 then has placed therein a flexible plastic container 92 which is provided with a spout, generally identified by the numeral 94.

The combination container and carton package is then closed by first inwardly folding the flaps 58, 62 and then inwardly folding the flaps 56, 60 into overlying relation to the flaps 58 and 62 and securing the flaps together in a conventional manner such as by adhesively bonding them. The spout 94 now underlies the deflectable flaps 72, 80.

The container assembly is then completed by passing T end portions 96 of a carrying strap 98 through the openings defined by the notches 88 and the openings defined by the opening 64 and cutouts 66. Next, a dust cover 100 is seated in the through opening 82 in overlying relation to the deflectable flaps 72, 80.

The container assembly is now complete.

Reference is now made to FIG. 5, wherein it is best shown that the plastic container 92 has a neck portion 102 which receives the spout 94. The spout 94 is normally separately formed from the container 92 and is suitably secured to the neck portion 102.

The spout 94 includes a base portion 104 which carries a flange 106. Extending upwardly from the base portion 104 is an externally threaded terminal spout portion 108 which is normally closed by a closure cap 110. The flange 106 may be peripherally shaped so as to facilitate gripping thereof and preventing rotation of the base 104 while the closure cap 110 is being rotated.

From the foregoing it will be apparent that the container spout 94 is prevented from accidentally projecting through the carton top closure by the dust cap 100 in combination with the deflectable flaps 72, 80. Normally, during shipment, the dust cover is held in place by strips of tape (not shown). The flaps 72, 80 provide a protective buffer between the spout and the dust cap.

It is to be understood that for dispensing purposes the spout 94 must project out of the top closure of the carton in the manner shown in FIG. 5. Depending upon filling conditions, normally the spout must also initially be so projected to effect the filling of the container 92. When it is desired to project the spout 94, the flaps 72, 80 are pulled up through the opening 82, after which the spout may be drawn through the same opening. The flaps 72, 80 are then folded beneath the flange 106 to lock the spout in its projected position.

Because the flaps 72, 80 are provided with intermediate score or fold lines 78, the flaps may be readily partially folded upon themselves so as to facilitate the releasing of the flaps 72, 80 from beneath the flange 106. With the flaps 72, 80 moved to out-of-the-way positions, the spout 94 may be pushed back into the carton 90 after which the flaps 72, 80 may be folded back into position and the dust cap or cover replaced.

Reference is now made to FIG. 6 wherein there is illustrated a slightly modified form of deflectable flap which is identified by the numeral 112. The flap 112 is of a semicircular outline and is primarily defined by a cut 114 which is interrupted at intervals to define connecting tabs 116 and 118 with the connecting tab 118 being generally parallel to the free edge of the respective inner closure flap. The connecting tab 118 thus functions as a hinge to permit bending or folding of the flap 112 with respect to its respective inner closure flap which is identified by the numeral 120, after the tabs 116 have been ruptured.

Although only a preferred embodiment of the carton has been specifically illustrated and described herein, it is to be understood that minor variations may be made therein without departing from the spirit and scope of the invention as defined by the appended claims.

We claim:

1. In a carton for a container having a spout, a closure flap arrangement, said closure flap arrangement comprising first and second inner flaps and first and second outer flaps, said outer flaps being bonded to said inner flaps, said inner flaps having free edges positionable in opposed adjacent relation, opening defining means formed in said inner flaps and opening through said free edges for alignment with each other when said free edges are in said opposed relation to define a single opening, said opening defining means being offset to one side of centers of said free edges, one of said outer flaps having a through opening formed therethrough remote from edges thereof and alignable with said single opening, each of said opening defining means including a deflectable flap formed from the respective inner flap and permanently hingedly connected to said respective inner flap along a hinge line generally parallel to and remote from said respective inner flap free edge.

2. In the carton of claim 1 wherein said through opening is of a size to receive said deflectable flaps when deflected outwardly from said inner flaps.

3. In the carton of claim 2 wherein each of said deflectable flaps has a free edge remote from its respective hinge line, said deflectable flaps free edges both being engageable with a container spout when projecting through said through opening to lock a container spout in a projecting position.

4. In the carton of claim 3, each of said deflectable flaps having an intermediate fold line extending thereacross generally parallel to said deflectable flap free edge for facilitating bending of said deflectable flap and releasing a locked container spout.

5. In the carton of claim 1, carrying strap receiving openings formed in said inner flaps, each strap receiving opening including an aperture and a slit extending from said aperture towards and terminating short of said free edge of the respective inner flap.

6. In the carton of claim 5, said outer flaps having free edges positionable in opposed adjacent relation and in general alignment with said carrying strap receiving openings, and generally arrow shaped notches formed in said outer flap free edges for alignment with said carrying strap openings, each notch including a head portion aligned with said aperture and a stem portion aligned with said slit.

7. In the carton of claim 1, a container within said carton, said container having a spout, said inner flaps lying in a first plane, said outer flaps lying in a second plane parallel to said first plane and being secured to said inner flaps, said spout generally underlying said through opening, and said deflectable flaps overlying said spout.

8. In the carton of claim 7, said container including a body, said container spout having a shoulder displaced from said container body, and said shoulder forming abutment means for said deflectable flaps.

9. In a carton for a container having a spout, a closure flap arrangement, said closure flap arrangement comprising first and second inner flaps and first and second outer flaps, said outer flaps being bonded to said inner flaps, said inner flaps having free edges positionable in opposed adjacent relation, opening defining means formed in said inner flaps and opening through said free edges for alignment with each other when said free edges are in said opposed relation to define a single opening, each of said opening defining means including a deflectable flap formed from the respective inner flap and permanently hingedly connected to said respective inner flap along a hinge line generally parallel to and remote from said respective inner flap free edge.

10. In the carton of claim 9, wherein each of said deflectable flaps has a free edge remote from its respective hinge line, said deflectable flaps free edges being engageable with a container spout.

11. In the carton of claim 10, each of said deflectable flaps having an intermediate fold line extending thereacross generally parallel to said deflectable flap free edge for facilitating bending of said deflectable flap and releasing a locked container spout.

* * * * *